US006231378B1

(12) United States Patent
Wu et al.

(10) Patent No.: US 6,231,378 B1
(45) Date of Patent: May 15, 2001

(54) ELECTRICAL CONNECTOR WITH IMPROVED SHIELD FOR A FLEXIBLE PRINTED CIRCUIT

(75) Inventors: Ming Chuan Wu, Shun-Lin; Ta Chin Lee, TaiChung, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,734

(22) Filed: Dec. 29, 1999

(51) Int. Cl.[7] ..... H01R 12/28
(52) U.S. Cl. ..... 439/495; 439/497
(58) Field of Search ..... 439/497, 493, 439/260, 495, 607

(56) References Cited

U.S. PATENT DOCUMENTS

| | | | | |
|---|---|---|---|---|
| 5,370,552 | * | 12/1994 | Chishima et al. | 439/495 |
| 5,401,186 | * | 3/1995 | Nozaki et al. | 439/260 |
| 5,474,468 | * | 12/1995 | Chishima et al. | 439/495 |
| 5,580,272 | * | 12/1996 | Yamaguchi et al. | 439/260 |
| 5,738,545 | * | 4/1998 | Igarashi et al. | 439/607 |
| 6,066,000 | * | 5/2000 | Masumoto et al. | 439/497 |

* cited by examiner

*Primary Examiner*—Gary F. Paumen
(74) *Attorney, Agent, or Firm*—Wei Te Chung

(57) ABSTRACT

An electrical connector comprises an insulative housing, a plurality of terminals received in the housing, an insulative stuffer and a conductive shield surrounding the housing. The housing comprises a top wall, a bottom wall, two side walls and a baffle between the top wall and the bottom wall. A receptacle and a plurality of channels are defined between the top wall and the baffle. A slot and a plurality of passageways are defined between the baffle and the bottom wall. Each terminal has an upper positioning portion and a contact portion both received in a corresponding channel, and a lower positioning portion received in a corresponding passageway. The shield is of a unitary construction and has a top panel, a bottom panel, a pair of front panels connecting the top panel to the bottom panel, and a pair of lateral panels together defining a space for enclosing the housing. A grounding panel is also connected to the top panel and enters into the receptacle when the shield is assembled to the housing; the stuffer has a main body for movably being received within the receptacle. In operation, the stuffer downwardly presses the grounding panel against an inserted flexible printed circuit to firmly clamp an inserted flexible printed circuit between the contact portion of the terminals and the grounding panel.

1 Claim, 5 Drawing Sheets

ELECTRICAL CONNECTOR WITH IMPROVED SHIELD FOR A FLEXIBLE PRINTED CIRCUIT

BACKGROUND OF THE INVENTION

The present invention relates to an electrical connector, and particularly to an electrical connector having a stuffer for abutting a flexible printed circuit into contact with a plurality of terminals, the inventive feature being on improved shield for the connector.

An electrical connector for connection with a FPC (flexible printed circuit) usually comprises an insulative housing, a plurality of terminals received in the housing, and an EMI shield adapted to surround the housing. The housing and the shield must remain in fixed positions relative to each other, particularly during connection and disconnection with a mating electrical connector. The conductive shield is generally constructed from two halves; a cooperating latching system being formed on both halves for securing each half together with the housing. More manufacturing steps and greater coordination during assembly are required. Additionally, a shield assembled from two halves is more susceptible to EMI since gaps between halves are easily introduced through assembly error. A shield having a unitary construction which can be smoothly and reliably assembled to a connector housing is desired.

SUMMARY OF THE INVENTION

Accordingly, the primary object of the present invention is to provide an electrical connector for connection with a flexible printed circuit having a shield with a unitary construction.

A second object of the present invention is to provide an electrical connector for connection with a flexible printed circuit having a shield which can be smoothly and reliably assembled onto the insulative housing, and which further will not separate from the housing during mating and unmating with a complementary electrical connector.

Accordingly, an electrical connector comprises an insulative housing, a plurality of terminals received in the housing, an insulative stuffer and a conductive shield surrounding the housing.

The housing comprises a top wall, a bottom wall, two side walls and a baffle between the top wall and the bottom wall. A receptacle and a plurality of channels are defined between the top wall and the baffle; a slot and a plurality of passageways are defined between the baffle and the bottom wall. Each terminal has an upper positioning portion and a contact portion both received in a corresponding channel, and a lower positioning portion received in a corresponding passageway. The shield is of a unitary construction and has a top panel covering the top wall of the housing, a bottom panel, a pair of front panels connected between the top panel and the bottom panel, a pair of lateral panels, and a grounding panel. The top panel, the bottom panel, the front panels and the lateral panels together define a space for enclosing the housing. The grounding panel is connected to the top panel and, in assembly, enters into the receptacle of the housing between the upper positioning portions and the contact portions of the terminals. The stuffer has a main body for movably being received within the receptacle. In operation, the stuffer downwardly presses the grounding panel against an inserted flexible printed circuit to firmly clamp the flexible printed circuit between the contact portion of the terminals and the grounding panel.

In accordance with a main feature of the present invention, a top wall of the housing defines a groove, and a clipping portion is correspondingly formed in the top panel of the shield for engaging with the groove. A flange is also formed at a rearward edge of the top panel for engaging with a rear edge of the top wall of the housing. These features secure the top panel of the shield to the top wall of the housing, protecting against separation of the shield from the housing during mating with a complementary connector.

Other objects, advantages and novel features of the invention will become more apparent from the following detailed description when taken in conjunction with the accompanying drawings.

DETAILED DESCRIPTION OF A PREFERRED EMBODIMENT

Figure 1:
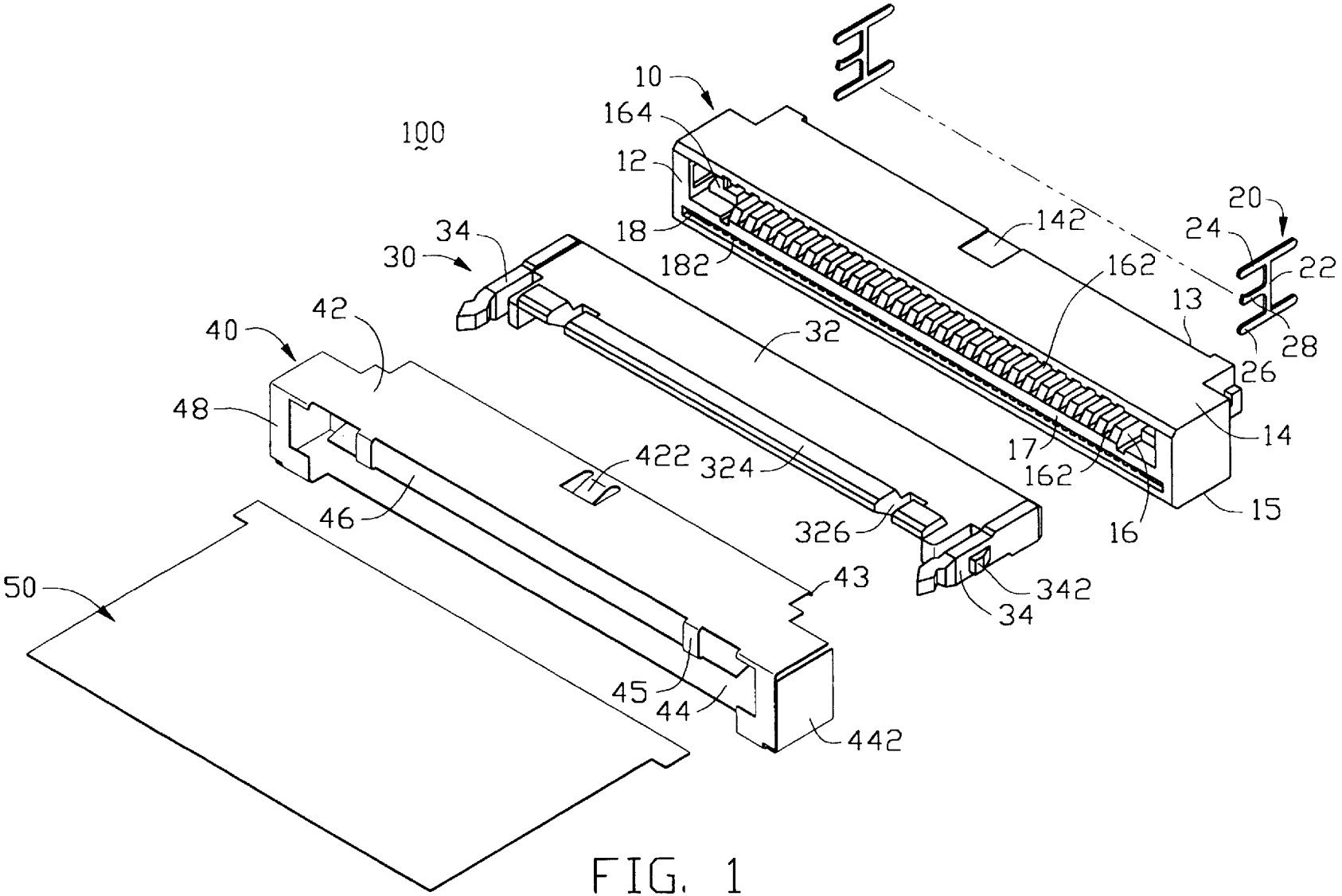
FIG. 1 is an exploded view of an electrical connector for connecting with a flexible printed circuit in accordance with the present invention.

Referring to FIG. 1, an electrical connector in accordance with the present invention comprises an insulative housing 10, a plurality of terminals 20 retained in the housing 10, an elongate stuffer 30 and a shield 40 covering the housing 10.

The elongate insulative housing 10 includes a mating face 12, a mounting opening 13 opposite the mating face 12, and a top wall 14 defining a groove 142 at a middle rear side thereof, and a bottom wall 15 opposite the top wall 14. A receptacle 16 and a slot 18 parallel to and beneath the receptacle 16 extend through the housing 10 from the mating face 12 to the mounting opening 13. A baffle 17 is formed between the receptacle 16 and the slot 18. A plurality of channels 162 is defined in both an inner surface (not labeled) of the top wall 14 and correspondingly in an upper surface (not labeled) of the baffle 17 in the receptacle 16. Two fasteners 164 are formed at both ends of the baffle 17 in the receptacle 16.

A plurality of passageways 182, equal in number to and correspondingly aligned with the plurality of channels 162, is defined both in a lower surface of the baffle 17 and in an upper surface of the bottom wall 15 in the slot 18.

Each terminal 20 is unitarily stamped and comprises a vertical supporting portion 22, a horizontal upper positioning portion 24 and a horizontal lower positioning portion 26 formed at both ends of the supporting portion 22, and a horizontal contact portion 28 formed at the middle of the supporting portion 22, the upper positioning portion 24, lower positioning portion 26 and contact portion 28 being parallel to one another.

The insulative stuffer 30 includes an elongate main body 32 and a pair of resilient arms 34 formed at opposite ends of the main body 32. A camming portion 324 extends from a forward edge of the main body 32, and a pair of notches 326 are defined near both ends of the camming portion 324. A protrusion 342 projects from a middle of an outer side of each resilient arm 34.

The shield 40 is unitarily stamped and includes a top panel 42, a bottom panel 44, a pair of front panels 48 connected between the top panel 42 and the bottom panel 44, and a pair of lateral panels 442 extending upward from the bottom panel 44 for cooperatively defining a space to enclose the housing 10. The top panel 42 is adapted to cover the top wall 14 of the housing 10 and forms a clipping portion 422 corresponding to the groove 142 of the top wall 14. A flange 424 is formed at a rear edge of the top panel 42 of the shield 40. A grounding panel 46 connected to the top panel 42 by a pair of connect portions 45 extends into the space at a slightly upward slant between the top panel 42 and the bottom panel 44.

Figure 2:
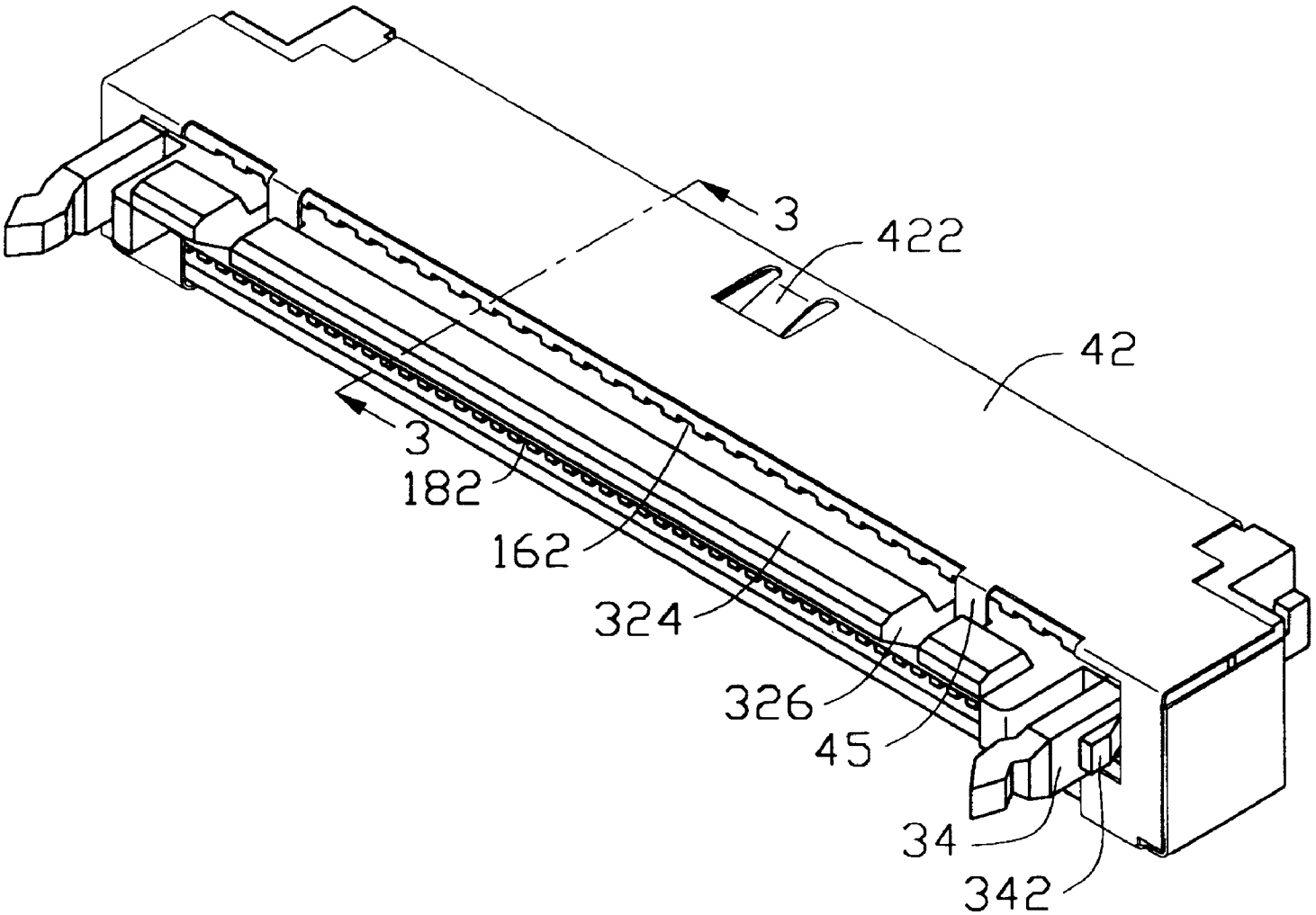
FIG. 2 is an assembled view of FIG. 1.
Figure 3:
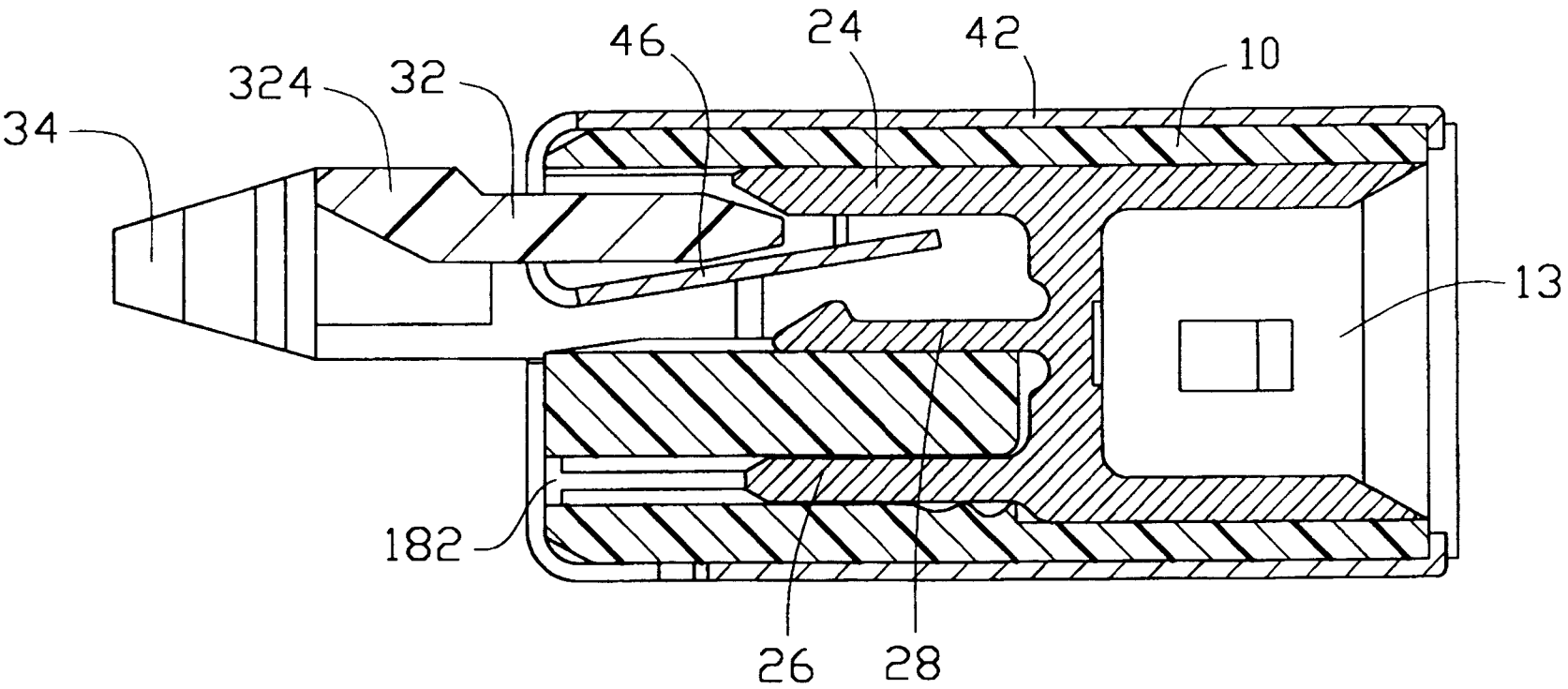
FIG. 3 is a cross-sectional view taken along line 3—3 of FIG. 2.
Figure 4:
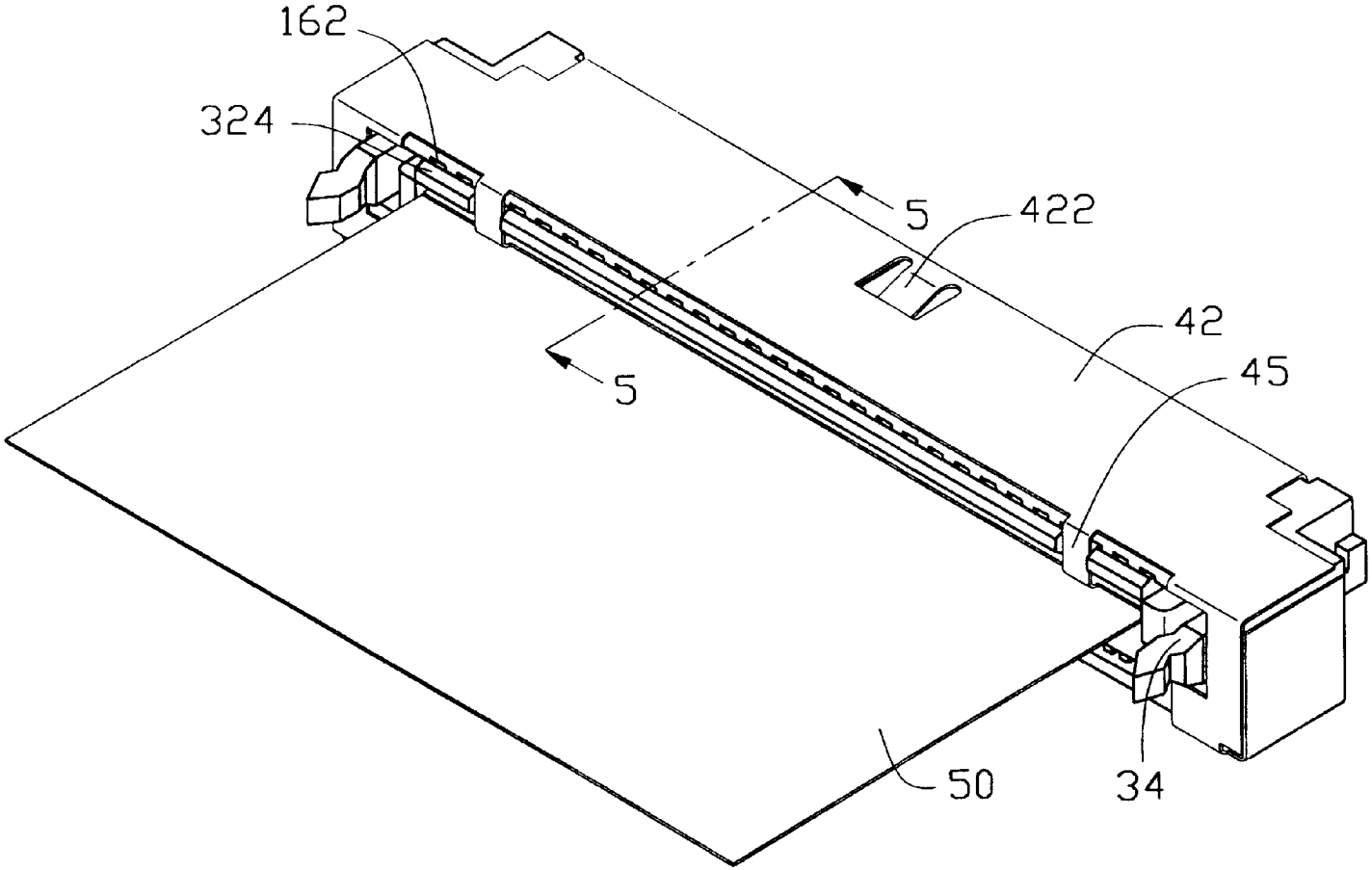
FIG. 4 is a view similar to FIG. 2, wherein a flexible printed circuit is inserted into the electrical connector.
Figure 5:
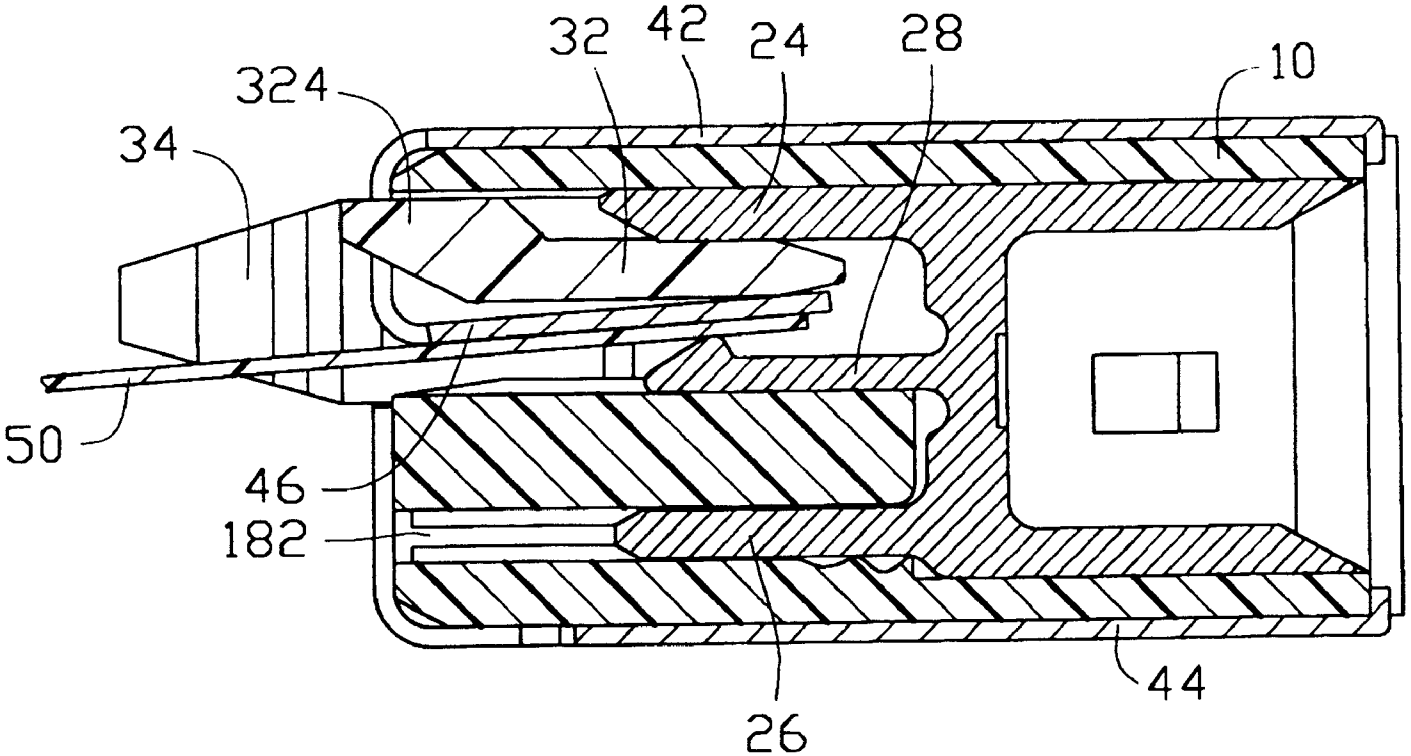
FIG. 5 is a cross-sectional view taken along line 5—5 of FIG. 4.

Also referring to FIGS. 2 and 3, in assembly, the terminals 20 are received in the housing 10 from the mounting opening 13 with the upper positioning portions 24 engaging with the channels 162 in the inner surface of the top wall 14, the contact portions 28 engaging with the channels 162 in the upper surface of the baffle 17, and the lower positioning portions 26 engaging with the passageways 182 of the slot 18. The stuffer 30 is inserted into the shield 40 between the top panel 42 and the grounding panel 46, the connect portions 45 entering into the notches 326 of the camming portion 324 of the stuffer 30. The shield 40 is then assembled over the housing 10 whereby the top panel 42 covers the top wall 14 of the housing 10, the grounding panel 46 and the main body 32 of the stuffer 30 enter into the receptacle 16 together, the front panels 48 cover opposite edges of the mating face 12, and the lateral panels 442 cover both ends of the housing 10. The clipping portion 422 correspondingly engages with the groove 142 of the housing 10 and the flange 424 engages with a rear edge of the top wall 14 thereby securing the top panel 42 from separating from the housing 10 when a mating connector (not shown) is mated or unmated with the mounting opening 13 of the electrical connector 100.

In a first operating position, the grounding panel 46 is located between the upper positioning portions 24 and the contact portions 28 of the terminals 20. A flexible printed circuit 50 is inserted into the receptacle 16 of the housing 10 between the grounding panel 46 of the shield 40 and the contact portions 28 of the terminals 20. To reach a second operating position, the camming portion 324 is then pushed into the receptacle 16 between the upper positioning portion 24 and the grounding panel 46 to downwardly press the grounding panel 46 to firmly clamp the flexible printed circuit 50 between the contact portions 28 of the terminals 20 and the grounding panel 46. At the same time, the stuffer 30 is positioned in the receptacle 16 with the protrusion 342 of the resilient arm 34 engaging with the fastener 164 of the baffle 17.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a mating face and a mounting opening on opposite sides of the housing, a receptacle and a slot extending through the housing from the mating face to the mounting opening, a baffle separating the receptacle from the slot, a plurality of channels defined in the receptacle, and a plurality of passageways defined in the slot;

a plurality of terminals each having an upper positioning portion and a contact portion both received in corresponding channels and a lower positioning portion received in a corresponding passageway of the insulative housing;

a metal shield being of a unitary construction and having a top panel, a bottom panel, a pair of front panels connected between the top panel and the bottom panel, the top panel, the bottom panel and the front panels together defining a space for enclosing the housing, and a grounding panel extending from the top panel and entering into the receptacle of the housing between the upper positioning portions and the contact portions of the plurality of terminals; and a stuffer having a main body movably received within the receptacle to downwardly press against the grounding panel to firmly clamp an inserted flexible printed circuit between the contact portions of the terminals and the grounding panel;

wherein a groove is defined in a top wall of the housing and a clipping portion is correspondingly formed in the top panel of the shield for engaging with the groove;

wherein a flange is formed at a rear edge of the top panel of the shield for engaging with a rear edge of the top wall of the housing;

wherein the shield further comprises a pair of lateral panels extending upwardly from the bottom panel;

wherein a camming portion is formed at an edge of the main body of the stuffer, a pair of notches being defined in the camming portion, and wherein a pair of connect portions are provided to connect the grounding panel with the top panel of the shield, the connect portions alignedly engaging with the notches.

* * * * *